US008399066B2

(12) United States Patent
Kurokawa et al.

(10) Patent No.: US 8,399,066 B2
(45) Date of Patent: Mar. 19, 2013

(54) NANOFIBER MANUFACTURING SYSTEM AND NANOFIBER MANUFACTURING METHOD

(75) Inventors: Takahiro Kurokawa, Osaka (JP); Hiroto Sumida, Nara (JP); Hiroyuki Tsuji, Kyoto (JP); Kazunori Ishikawa, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/520,416

(22) PCT Filed: Sep. 22, 2011

(86) PCT No.: PCT/JP2011/005346

§ 371 (c)(1),
(2), (4) Date: Jul. 3, 2012

(87) PCT Pub. No.: WO2012/042802

PCT Pub. Date: Apr. 5, 2012

(65) Prior Publication Data

US 2012/0282411 A1 Nov. 8, 2012

(30) Foreign Application Priority Data

Sep. 29, 2010 (JP) ..... 2010-219153

(51) Int. Cl.

| | |
|---|---|
| ***B05C 5/04*** | (2006.01) |
| ***B05C 11/00*** | (2006.01) |
| ***B05D 1/06*** | (2006.01) |
| ***B29B 9/00*** | (2006.01) |

(52) U.S. Cl. ..... 427/462; 427/482; 118/621; 118/638; 977/890; 977/901; 264/6

(58) Field of Classification Search ..... 427/462, 427/482; 118/621, 638; 977/890, 901; 264/6
See application file for complete search history.

(56) References Cited

U.S. PATENT DOCUMENTS

| | | | | |
|---|---|---|---|---|
| 2002/0122840 | A1* | 9/2002 | Lee et al. | 425/174.6 |
| 2008/0122142 | A1 | 5/2008 | Kim et al. | |
| 2010/0092687 | A1* | 4/2010 | Sumida et al. | 427/472 |
| 2011/0212321 | A1* | 9/2011 | Cakmak et al. | 428/323 |

FOREIGN PATENT DOCUMENTS

JP 2008-519175 6/2008

(Continued)

OTHER PUBLICATIONS

International Search Report issued Jan. 17, 2012 in International (PCT) Application No. PCT/JP2011/005346.

*Primary Examiner* — Frederick Parker
(74) *Attorney, Agent, or Firm* — Wenderoth, Lind & Ponack, L.L.P.

(57) ABSTRACT

A nanofiber manufacturing system in which nanofiber is formed from a raw material liquid by electrostatic explosions in a nanofiber forming space and the formed nanofiber is collected and deposited on a main surface of a base sheet. The system includes: a first dielectric belt having dielectric property; sheet conveying devices for conveying the base sheet in the nanofiber forming space; a sheet contacting device for putting a back surface of the base sheet and a first surface of the first dielectric belt into contact with each other; a dielectric belt driving device for running the first dielectric belt in a conveyance direction of the base sheet within the nanofiber forming space while the first surface is kept in contact with the back surface of the base sheet; and a voltage applying device for applying a voltage to the second surface of the first dielectric belt so that dielectric polarization occurs to the first dielectric belt.

12 Claims, 5 Drawing Sheets

FOREIGN PATENT DOCUMENTS

| | | | |
|---|---|---|---|
| JP | 2008-190090 | | 8/2008 |
| JP | 2008-196061 | | 8/2008 |
| JP | 2009-052163 | * | 3/2009 |
| JP | 2009-52163 | | 3/2009 |
| JP | 2010-133039 | * | 6/2010 |
| JP | 2011-140740 | | 7/2011 |

* cited by examiner

NANOFIBER MANUFACTURING SYSTEM AND NANOFIBER MANUFACTURING METHOD

TECHNICAL FIELD

The present invention relates to a nanofiber manufacturing system, as well as a nanofiber manufacturing method, for manufacturing high-polymer nanofibers from high-polymer solutions by electrostatic explosions.

BACKGROUND ART

Conventionally, there has been known a nanofiber manufacturing apparatus having a collector member with a specified voltage applied thereto, and a nozzle which is located at a specified distance from the collector member and to which a voltage having a specified voltage difference to the collector member is applied. The nozzle with a voltage applied thereto electrically charges and simultaneously delivers out a raw material liquid (high-polymer solution) of nanofiber toward the collector member. The delivered-out raw material liquid, while dried with its solvent evaporating, goes toward the collector member. While moving toward the collector member, the raw material liquid has the solvent increasingly evaporating so as to cause electrostatic explosions, being drawn and finally formed into nanofiber. The formed nanofiber is deposited on a base sheet placed on the collector member by electrostatic collection by the collector member. As the solvent adhering to the nanofiber deposited on the base sheet has fully been evaporated, a base sheet with a nanofiber layer formed thereon is completed.

As the collector member of the collecting device acting for electrostatic collection and deposition of nanofiber on the base sheet, those in various modes have been known. A nanofiber manufacturing apparatus described in PTL 1 employs an electrically conductive belt as the collector member. Nanofiber is deposited on a base sheet on the conductive belt. A voltage is applied to the conductive belt indirectly with a voltage applied to a roll that supports the conductive belt.

A nanofiber manufacturing apparatus described in PTL 2 employs an electrically conductive plate-shaped collector member. This conductive plate-shaped collector member has a plurality of holes formed for blowing out air toward the base sheet on the conductive plate-shaped collector member.

Also, a nanofiber manufacturing apparatus described in PTL 3 employs a collector member composed of a plurality of electrodes, which are in contact with the base sheet, and an endless resin belt which supports the electrodes.

Still also, a nanofiber manufacturing apparatus described in PTL 4 employs, as the collector member, a plurality of brush-like electrodes being in sliding contact with the surface of the base sheet.

CITATION LIST

Patent Literature

PTL 1: JP 2008-196061 A
PTL 2: JP 2008-190090 A
PTL 3: JP 2009-52163 A
PTL 4: JP 2010-133039 A

SUMMARY OF INVENTION

Technical Problem

However, in the nanofiber manufacturing apparatus described in PTL 1, since the collector member is an electrically conductive belt, nanofiber is more likely to be deposited concentratedly at a portion of the base sheet positioned at the collector member portion that is at the shortest distance from the nozzle.

Also in the nanofiber manufacturing apparatus described in PTL 2, since the collector member is electrically conductive, nanofiber is more likely to be deposited concentratedly at a portion of the base sheet positioned at the collector member portion that is at the shortest distance from the nozzle, as in the case of the nanofiber manufacturing apparatus described in PTL 1.

In the nanofiber manufacturing apparatus described in PTL 3, nanofiber is more likely to be deposited concentratedly at the base sheet portion positioned near the electrode of the collector member that is at the shortest distance from the nozzle.

Similarly, also in the nanofiber manufacturing apparatus described in PTL 4, nanofiber is more likely to be deposited concentratedly at the base sheet portion positioned near the electrode of the brush-like electrode that is at the shortest distance from the nozzle.

As shown above, in any one of the nanofiber manufacturing apparatuses described in PTLs 1-4, there is a tendency that nanofiber is deposited concentratedly at portions on the base sheet. The shorter the distance becomes between the nozzle for delivering out the raw material liquid and the collector member for electrostatically collecting nanofiber onto the base sheet, the more the collecting force increases at the portion of the collector member positioned at the shortest distance from the nozzle, so that nanofiber is deposited concentratedly at the portion of the base sheet positioned at the collector member portion where the collecting force has increased. In addition, indeed it is conceivable to sufficiently increase the distance between the nozzle and the collector member, but that may be impracticable due to restraints of apparatus size.

When nanofiber has been deposited concentratedly at portions on the base sheet, solvent adhering to the nanofiber becomes less likely to evaporate. As a result, the solvent remaining without evaporating may cause nanofiber to be re-liquefied on the base sheet.

Accordingly, an object of the present invention is, in nanofiber manufacture including deposition of nanofiber on a base sheet on a collector member of a collecting device, to relax concentration of nanofiber to portions of the base sheet, thereby dispersing the nanofiber over the whole base sheet, so as to suppress reliquefaction of nanofiber on the base sheet.

Solution to Problem

In order to achieve the object, the invention is configured as follows.

According to a first aspect of the invention, there is provided a nanofiber manufacturing system in which nanofiber is formed from a raw material liquid by electrostatic explosions in a nanofiber forming space and the formed nanofiber is collected and deposited on a main surface of a base sheet, comprising:

a first dielectric belt having dielectric property and including first and second surfaces;

a sheet conveying device for conveying the base sheet in the nanofiber forming space;

a sheet contacting device for putting a back surface of the base sheet and the first surface of the first dielectric belt into contact with each other;

a dielectric belt driving device for running the first dielectric belt in a base-sheet conveyance direction within the nanofiber forming space while the first surface of the first dielectric belt is kept in contact with the back surface of the base sheet; and a voltage applying device for applying a voltage to the second surface of the first dielectric belt so that dielectric polarization occurs to the first dielectric belt.

According to a second aspect of the invention, there is provided the nanofiber manufacturing system according to the first aspect of the invention, further comprising a second dielectric belt having dielectric property which is moved in a running direction of the first dielectric belt while being kept in contact with the second surface of the first dielectric belt, wherein the voltage applying device applies a voltage to the second surface of the first dielectric belt via the second dielectric belt.

According to a third aspect of the invention, there is provided the nanofiber manufacturing system according to the first aspect of the invention, further comprising a conductive belt having electrical conductivity which is moved in a running direction of the first dielectric belt while being kept in contact with the second surface of the first dielectric belt, wherein the voltage applying device applies a voltage to the second surface of the first dielectric belt via the conductive belt.

According to a fourth aspect of the invention, there is provided the nanofiber manufacturing system according to any one of the first to third aspect of the invention, wherein the voltage applying device includes at least one or more electrodes for applying a voltage to the second surface of the first dielectric belt, and wherein the at least one or more electrodes are formed in a plate shape and placed so as to be arrayed in a direction orthogonal to the sheet conveyance direction.

According to a fifth aspect of the invention, there is provided the nanofiber manufacturing system according to any one of the first to third aspect of the invention, wherein the voltage applying device includes at least one or more electrodes for applying a voltage to the second surface of the first dielectric belt, and wherein the at least one or more electrodes are formed in a rotatable roll shape.

According to a sixth aspect of the invention, there is provided the nanofiber manufacturing system according to any one of the first to fifth aspect of the invention, wherein the dielectric belt driving device includes a driving roll which, while supporting the first dielectric belt, is rotated so as to ran the first dielectric belt, and wherein the driving roll is placed outside the nanofiber forming space.

According to a seventh aspect of the invention, there is provided the nanofiber manufacturing system according to any one of the first to sixth aspect of the invention, wherein the base sheet is an elongate base sheet which passes through the nanofiber forming space, and the sheet conveying device comprises:

a sheet feeding device which is placed outside the nanofiber forming space and which feeds out the base sheet toward within the nanofiber forming space; and a sheet recovering device which is placed outside the nanofiber forming space and which recovers the base sheet on which nanofiber has been deposited and which has passed through the nanofiber forming space.

According to a eighth aspect of the invention, there is provided the nanofiber manufacturing system according to any one of the first to seventh aspect of the invention, further comprising a drying device for drying nanofiber deposited on the base sheet.

According to a ninth aspect of the invention, there is provided the nanofiber manufacturing system according to any one of the first to eighth aspect of the invention, further comprising a static elimination device for eliminating static charge from the base sheet with nanofiber deposited thereon.

According to a tenth aspect of the invention, there is provided a nanofiber manufacturing method in which nanofiber is formed from a raw material liquid by electrostatic explosions in a nanofiber forming space and the formed nanofiber is collected and deposited on a main surface of a base sheet, comprising:

conveying the base sheet in the nanofiber forming space;

putting a back surface of the base sheet and a first surface of a first dielectric belt of dielectric property into contact with each other;

running the first dielectric belt having dielectric property in a conveyance direction of the base sheet while the first dielectric belt is kept in contact with the base sheet; and applying a voltage to a second surface of the first dielectric belt so that dielectric polarization occurs to the first dielectric belt, whereby nanofiber is electrostatically collected onto the main surface of the base sheet.

According to an eleventh aspect of the invention, there is provided the nanofiber manufacturing method according to the tenth aspect of the invention, further comprising:

running a second dielectric belt having dielectric property in a running direction of the first dielectric belt while the second dielectric belt is kept in contact with the second surface of the first dielectric belt; and applying a voltage to the second surface of the first dielectric belt via the second dielectric belt.

According to an twelfth aspect of the invention, there is provided the nanofiber manufacturing method according to the tenth aspect of the invention, further comprising:

running an electrically conductive belt in a running direction of the first dielectric belt while the conductive belt is kept in contact with the second surface of the first dielectric belt; and applying a voltage to the second surface of the first dielectric belt via the conductive belt.

Advantageous Effects of Invention

According to the present invention, a voltage is applied to the second surface of the first dielectric belt running in the base-sheet conveyance direction within the nanofiber forming space while the back surface of the base sheet and the first surface of the first dielectric belt are kept in close contact with each other, so that dielectric polarization occurs to the first dielectric belt. As a result of this, nanofiber is deposited dispersedly on the main surface of the base sheet. Thus, reliquefaction of nanofiber on the base sheet, which could occur due to partly concentrated deposition of nanofiber on the base sheet, is suppressed.

BRIEF DESCRIPTION OF DRAWINGS

The above aspects and features of the present invention will become more apparent from the following description of preferred embodiments thereof with reference to the accompanying drawings, and wherein.

DESCRIPTION OF EMBODIMENTS

Hereinbelow, embodiments of the present invention will be described with reference to the accompanying drawings.

First Embodiment

Figure 1:
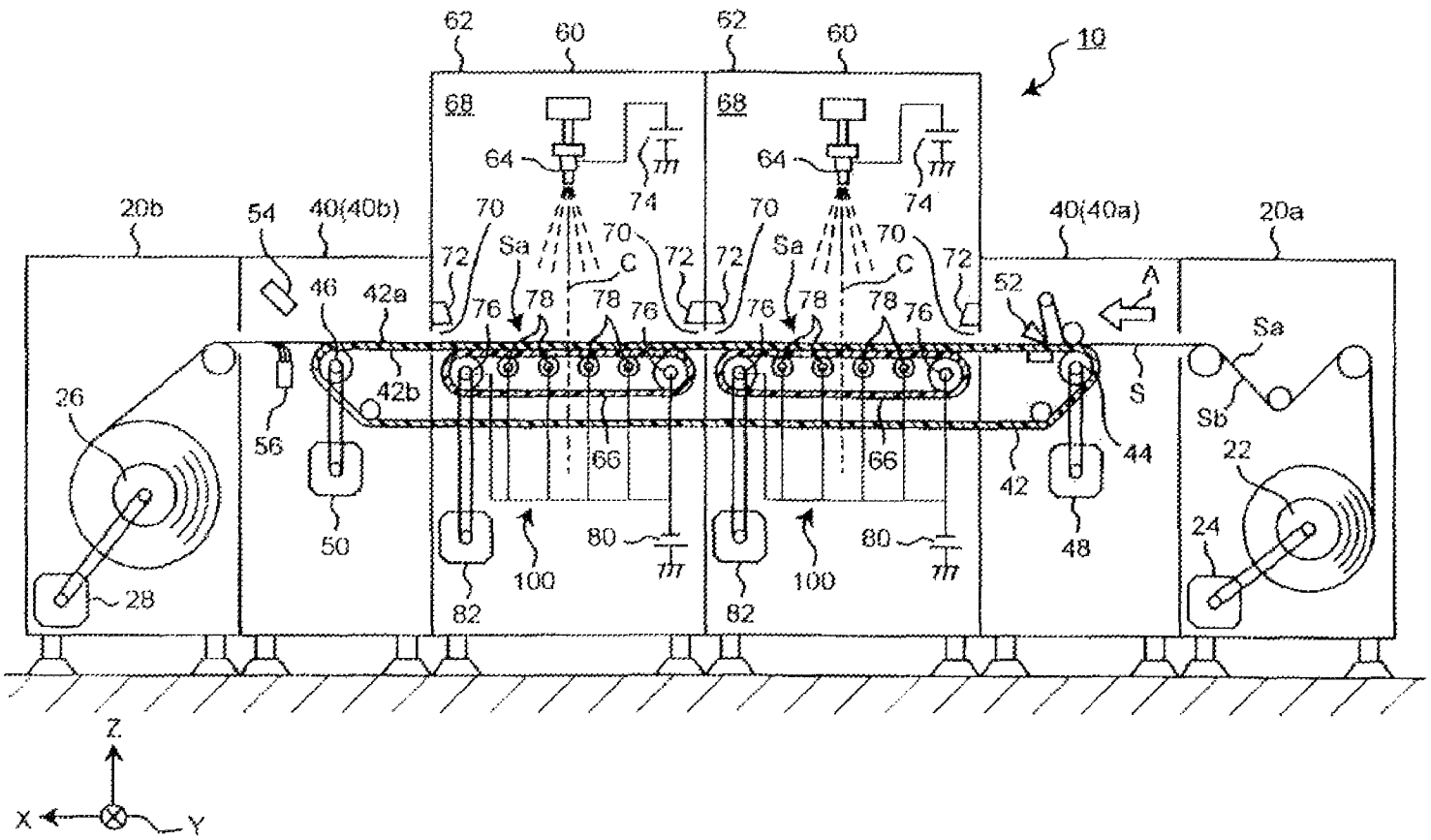
FIG. 1 is a view schematically showing a configuration of a nanofiber manufacturing system according to a first embodiment of the present invention.

FIG. 1 schematically shows a configuration of a nanofiber manufacturing system according to a first embodiment of the invention. The nanofiber manufacturing system 10 shown in FIG. 1 works to form nanofiber from a nanofiber raw material liquid (polymer solution) by electrostatic explosions and collects and deposits the formed nanofiber with electrostatic collecting force effectuated by a collector member 42 of a collecting device 100 in which voltages (e.g., 10-100 kV) are applied to a main surface Sa of a base sheet S made of polyethylene or other resin. Thus, a nanofiber sheet (a base sheet S with a nanofiber layer formed thereon) is fabricated.

It is noted that the term 'nanofiber' herein refers to a filamentary substance formed from a high-polymer substance and having a submicron-scale or nano-scale diameter. Applicable as the high-polymer substance are various high-polymers such as polyvinylidene fluoride (FVDF), polyvinylidene fluoride-co-hexafluoropropylene, polyacrylonitrile, polymethyl methacrylate, polyethylene, polypropylene or other petroleum polymers or biopolymers, as well as copolymers or mixtures of those substances. The nanofiber raw material liquid is a solution resulting from dissolving those high-polymer substances with a solvent.

Also, the terms 'upstream side' and 'downstream side' herein refer to upstream side and downstream side, respectively, with respect to a base sheet conveyance direction A (direction indicated by a hollow arrow in the figure).

The nanofiber manufacturing system 10 shown in FIG. 1 conveys an elongate base sheet S in a lengthwise direction (X-axis direction) and, amid the conveyance, electrostatically collects and deposits nanofiber, which has been generated by a nozzle 64, onto a main surface Sa of the base sheet S by the collector 100.

More specifically, the nanofiber manufacturing system 10, as shown in FIG. 1, includes a base sheet feeding device 20*a* and a base sheet recovering device 20*b* for conveying the base sheet S, a dielectric belt driving device 40 (40*a*, 40*b*) for running a first dielectric belt 42 in parallel with the base sheet S, and two (first and second) nanofiber manufacturing apparatuses 60 for each forming a nanofiber layer on the main surface Sa of the base sheet S.

The base sheet feeding device 20*a* and the base sheet recovering device 20*b* convey the base sheet S so that the base sheet S passes through the dielectric belt driving device 40 and the two nanofiber manufacturing apparatuses 60 in a horizontal direction (X-axis direction) with the main surface Sa of the base sheet S directed toward a vertical direction (Z-axis direction). More specifically, as shown in FIG. 1, in the nanofiber manufacturing system 10, the base sheet feeding device 20*a* is positioned on the most upstream side with respect to the conveyance direction A of the base sheet S, while the base sheet recovering device 20*b* is positioned on the most downstream side. Then, the dielectric belt driving device 40 (40*a*, 40*b*) and the two nanofiber manufacturing apparatuses 60 are positioned between the base sheet feeding device 20*a* and the base sheet recovering device 20*b*.

The base sheet feeding device 20*a* feeds out the base sheet S wound on a feed reel 22 toward the downstream-side base sheet recovering device 20*b*. For this purpose, the base sheet feeding device 20*a* has a motor 24 for rotating the feed reel 22.

On the other hand, the base sheet recovering device 20*b* winds up the base sheet S having a nanofiber layer formed thereon by the nanofiber manufacturing apparatuses 60, and recovers the base sheet S to a recovery reel 26. For this purpose, the base sheet recovering device 20*b* has a motor 28 for rotating the recovery reel 26.

The motor 24 for rotating the feed reel 22 and the motor 28 for rotating the recovery reel 26 are controlled by a control unit (not shown) of the nanofiber manufacturing system 10 so that the two reels 22, 26 are rotated at a rotating speed that keeps a constant conveyance speed of the base sheet S passing through the nanofiber manufacturing apparatuses 60, in which a nanofiber layer is formed on the base sheet S. As a result, the base sheet S is conveyed with a specified tension maintained. In addition, the control unit of the nanofiber manufacturing system 10 is so structured as to integrally control and manage a plurality of devices constituting the system.

As described above (as shown in FIG. 1), means for conveying the base sheet S is provided as it is divided into the base sheet feeding device 20*a* and the base sheet recovering device 20*b*, so that the degree of freedom for the structure of the nanofiber manufacturing system 10 is increased. For example, it is possible to change the number of nanofiber manufacturing apparatuses 60 to be installed between the base sheet feeding device 20*a* and the base sheet recovering device 20*b*.

The dielectric belt driving device 40 is a device for running the first dielectric belt 42 in contact with a back surface Sb (surface opposed to the main surface Sa) of the base sheet S conveyed in the X-axis direction. The dielectric belt driving device 40 is composed of an upstream-side dielectric belt driving device 40*a* positioned on the upstream side with respect to the conveyance direction A of the base sheet S, and a downstream-side dielectric belt driving device 40*b* positioned on the downstream side more than the upstream-side dielectric belt driving device 40*a*. Between the upstream-side dielectric belt driving device 40*a* and the downstream-side dielectric belt driving device 40*b* as shown above, as shown in FIG. 1, two nanofiber manufacturing apparatuses 60 as an example are placed. Therefore, the first dielectric belt 42 run by the dielectric belt driving device 40 passes through the two nanofiber manufacturing apparatuses 60.

The first dielectric belt 42, being a part of the collector (collecting device) 100 for electrostatically collecting nanofiber to the base sheet S, is a belt made from a dielectric such as resin and having dielectric property. Portion of the first dielectric belt 42 in contact with the base sheet S runs in the X-axis direction.

More specifically, an upstream-side end of the first dielectric belt 42 is supported by a rotatable driving roll 44 provided in the upstream-side dielectric belt driving device 40*a*. Meanwhile, a downstream-side end of the first dielectric belt 42 is supported by a rotatable driving roll 46 provided in the downstream-side dielectric belt driving device 40*b*. These driving rolls 44, 46 are driven and rotated by motors 48, 50. The motors 48, 50 are controlled by the control unit (not shown) of the nanofiber manufacturing system 10 so that the two driving rolls 44, 46 are synchronously rotated. By such driving rolls 44, 46, a portion of the first dielectric belt 42 in contact with the base sheet S is run in the X-axis direction while a specified tension is maintained. The motor for running the first dielectric belt 42 may be only either one of the motors 48, 50.

The upstream-side dielectric belt driving device 40*a* has a squeegee 52 as a means for putting the back surface Sb of the base sheet S, on which the nanofiber layer has not yet been formed, and a first surface 42*a* of the first dielectric belt 42 into close contact with each other. This squeegee 52 is intended to put the back surface Sb of the base sheet S and the first surface 42*a* of the first dielectric belt 42 into close contact with each other without intervention of air bubbles and moreover without occurrence of wrinkles. The base sheet S is thinner and less elastic than the first dielectric belt 42, thus being likely to come into close contact with the first dielectric belt 42 with intervention of air bubbles and with occurrence of wrinkles. Particularly with the base sheet S and the first dielectric belt 42 both formed from resin, when the base sheet S and the first dielectric belt 42 are brought into contact with each other in a charged state, it becomes hard to shift or stretch one against the other, so that air therebetween becomes hard to bleed away. Problems of wrinkles and air bubbles are solved by the squeegee 52, so that the base sheet S and the first dielectric belt 42 are allowed to pass in their close contact state through the nanofiber manufacturing apparatuses 60.

In addition, preferably, the control unit of the nanofiber manufacturing system 10 controls the conveyance speed of the base sheet S and the running speed of the first dielectric belt 42 in synchronism with each other so that the base sheet S and the contact portion of the first dielectric belt 42 with the base sheet S can be moved in the X-axis direction at equal speed. With a larger difference in speed between the conveyance speed of the base sheet S and the running speed of the first dielectric belt 42, there arises friction due to the speed difference and the friction may cause occurrence of wear and/or damage on at least one of the first dielectric belt 42 or the base sheet S.

Further, the downstream-side dielectric belt driving device 40*b* has a drying device 54 for drying, with hot air, the nanofiber layer formed on the main surface Sa of the base sheet S. As a result, reliquefaction of nanofiber is suppressed and moreover the base sheet S having a sufficiently dried nanofiber layer is wound on the recovery reel 26 of the base sheet recovering device 20*b*.

Furthermore, the downstream-side dielectric belt driving device 40*b* has a static elimination device 56 for eliminating static charge to suppress occurrence of separation charging that could occur upon separation (strip-off) of the base sheet S and the first dielectric belt 42 from each other. As a result, occurrence of sparks that could occur due to separation charging can be suppressed, so that breakage of the nanofiber layer on the base sheet S due to sparks is prevented.

The or each nanofiber manufacturing apparatus 60 includes a housing 62, a nozzle 64 for discharging out the raw material liquid, and a second dielectric belt 66 forming part of the collector (collecting device) 100.

The housing 62 of the nanofiber manufacturing apparatus 60 defines a nanofiber forming space 68 for forming nanofiber from the raw material liquid by electrostatic explosions. Also, the housing 62 has an opening 70, which is a doorway for the base sheet S to the nanofiber forming space 68 so that the base sheet S and the first dielectric belt 42 in contact therewith are allowed to pass through the nanofiber forming space 68 in the X-axis direction. In addition, near the opening 70, a suction duct 72 for sucking up nanofiber is provided so that nanofiber formed within the nanofiber forming space 68 is prevented from leaking outside the nanofiber forming space 68 via the opening 70.

The nozzle 64 of the nanofiber manufacturing apparatus 60 is placed in the nanofiber forming space 68 so as to face the first dielectric belt 42 with a specified distance (e.g., 100-600 mm) to the base sheet S and with the base sheet S interposed therebetween. A specified voltage is applied to the nozzle 64 by a voltage applying device 74. The specified voltage, as will be described later, is such a voltage as to yield a specified voltage difference to the voltage applied to the second dielectric belt 66, i.e., a voltage resulting in such a voltage difference (e.g., 20-200 kV) that causes occurrence of electrostatic explosions and that resultantly allows nanofiber to be formed from the raw material liquid. As a result, the nozzle 64 is enabled to discharge out nanofiber into the nanofiber forming space 68 while electrically charging the raw material liquid, so that the discharged-out raw material liquid is formed into nanofiber by electrostatic explosions.

The second dielectric belt 66 of the nanofiber manufacturing apparatus 60 is a belt which forms part of the collector (collecting device) 100 for electrostatically collecting nanofiber to the base sheet S and which is made from a dielectric such as resin so as to have dielectric property. This second dielectric belt 66 is placed at such a position in the nanofiber forming space 68 as to face the base sheet S with the first dielectric belt 42 interposed therebetween, and is in contact with a second surface 42*b* (surface opposite to the first surface 42*a*) of the first dielectric belt 42.

Also, with a voltage applied to the second dielectric belt 66, a portion of the second dielectric belt 66 in contact with the first dielectric belt 42 runs in the X-axis direction. More specifically, both ends of the second dielectric belt 66 are supported by rotatable electrode rolls (i.e., cylindrical-shaped rotatable electrodes) 76. Further, a plurality of rotatable electrode rolls 78 for pressing the second dielectric belt 66 against the first dielectric belt 42 to maintain the contact of the two belts 66, 42 are provided so as to be arrayed in the X-axis direction.

The electrode rolls 76, 78 are electrodes of a voltage applying device 80 which are put into contact with the second dielectric belt 66 to apply voltage and which are formed, from, for example, metal or other electrical conductor.

Figure 2:
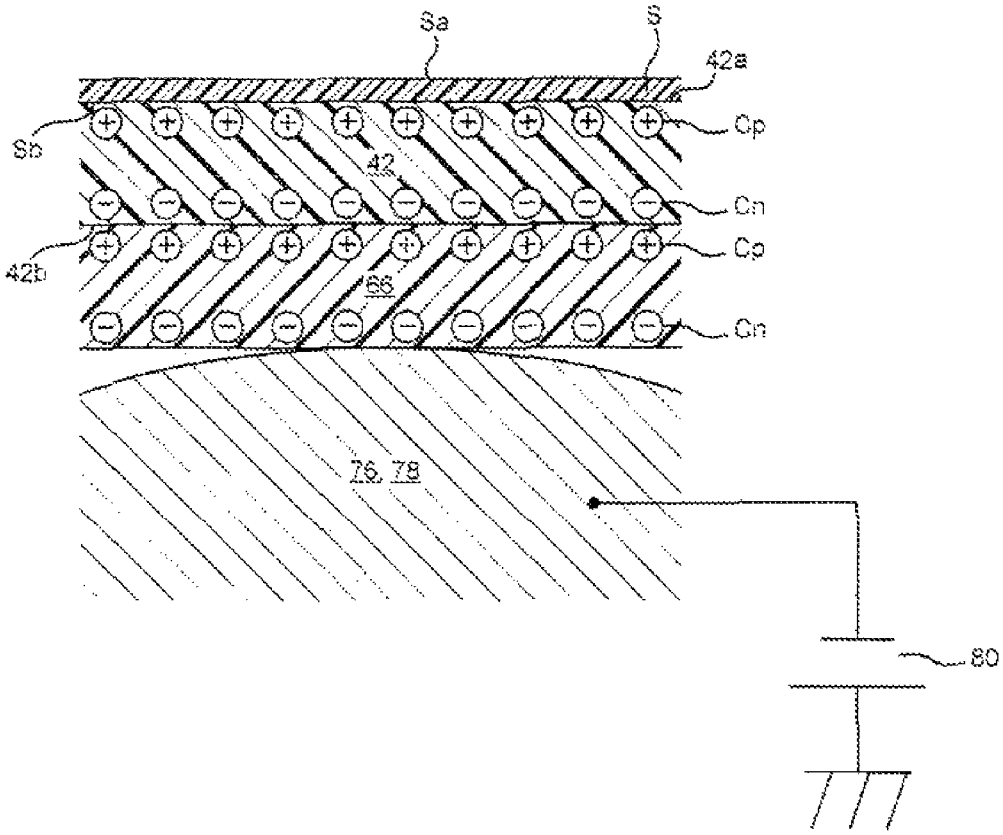
FIG. 2 is a view for explaining dielectric polarization of a first dielectric belt.

When the voltage is applied via the electrode rolls 76, 78 to the second dielectric belt 66 by the voltage applying device 80, there occurs dielectric polarization to both the first dielectric belt 42 and the second dielectric belt 66 as shown in FIG. 2.

For example, when a voltage is applied to the electrode rolls 76, 78 by the voltage applying device 80, negative electric charge Cn is generated uniformly on a surface of the second dielectric belt 66 on one side for contact with the electrode rolls 76, 78. Along with this, positive electric charge Cp is generated uniformly on a surface of the second dielectric belt 66 on one side for contact with the first dielectric belt 42.

As a result of dielectric polarization of the second dielectric belt 66 as described above, negative electric charge Cn is generated uniformly on the second surface 42*b* of the first dielectric belt 42. Along with this, positive electric charge Cp is generated uniformly on the first surface 42*a* of the first dielectric belt 42.

As a result of uniform generation of unipolar charge Cp on the first surface 42*a* of the first dielectric belt 42 to be in contact with the base sheet S, nanofiber is deposited uniformly on the main surface Sa of the base sheet S without partly concentrated deposition on the base sheet S. Consequently, a nanofiber layer of uniform thickness is formed on the main surface Sa of the base sheet S.

Further, at least one of the electrode rolls 76 is driven and rotated by a motor 82 so as to serve as a driving roll for running the second dielectric belt 66. The motor 82 is controlled by the control unit (not shown) of the nanofiber manufacturing system 10.

In order that mutual contact portions of the second dielectric belt 66 and the first dielectric belt 42 can be moved at equal speed in the X-axis direction, the control unit of the nanofiber manufacturing system 10 preferably controls the running speed of the second dielectric belt 66 and the running speed of the first dielectric belt 42 in synchronism with each other. A reason of this is that with a large speed difference between the running speed of the second dielectric belt 66 and the running speed of the first dielectric belt 42, there arises friction due to the speed difference so that, as a result of the friction, wear or damage may occur to at least one of the second dielectric belt 66 or the first dielectric belt 42. Another reason is that there arises a gap (arises a noncontact region) partly between the second dielectric belt 66 and the first dielectric belt 42, so that uniform generation of electric charge on the first surface 42*a* of the first dielectric belt 42 to be in contact with the base sheet S may be suppressed resultantly.

Also, in a case where the second dielectric belt 66 and the first dielectric belt 42 effectuate electrostatic collection (sucking-up) to each other during the formation of nanofiber so that the second dielectric belt 66 substantially runs along with the first dielectric belt 42 so as to follow the first dielectric belt 42 without increasing the sliding resistance, the motor 82 for running the second dielectric belt 66 may be omitted from the nanofiber manufacturing apparatus 60.

Further, with respect to widths (Y-axis direction lengths) of the first dielectric belt 42 and the second dielectric belt 66 orthogonal to the conveyance direction A of the base sheet S, the width of the first dielectric belt 42 should be made larger. If the width of the second dielectric belt 66 is larger, the second dielectric belt 66 is partly exposed from the first dielectric belt 42, so that nanofiber is deposited concentratedly at the exposed part. From the same reason, Y-axis direction lengths of the electrode rolls 76, 78 should be made smaller than the Y-axis direction length of the first dielectric belt 42.

In addition, a plurality of electrode rolls 76, 78 are placed so as not to be placed at a position on straight line C passing through the nozzle 64 and a portion of the base sheet S which positioned at the shortest distance from the nozzle 64, i.e., corresponding to a position just below the nozzle 64. Preferably, a plurality of electrode rolls 76, 78 are placed symmetrical with respect to the straight line C. As a result of this, nanofiber formed from the raw material liquid discharged from the nozzle 64 can be inhibited from being deposited concentratedly on the portion of the base sheet S positioned at the shortest distance from the nozzle 64, and is deposited over a wide range of the base sheet S. It is noted that, in case the electrode roll is only one, the electrode roll may be placed just below the nozzle 64.

Furthermore, instead of the electrode rolls 76, a driving roll for running the second dielectric belt 66 may be provided additionally. As a result of this, the electrode rolls 76 are permitted to function only for voltage application to the second dielectric belt 66, and its structure can be simplified. For example, when the electrode rolls 76 are driven by and coupled to the motor to fulfill the role as driving rolls, the electrode rolls 76 and the motor have to be coupled to each other via a dielectric so as to prevent the motor from being damaged by the voltage applied to the electrode rolls 76.

Now, the method for manufacturing a nanofiber sheet (base sheet S with a nanofiber layer formed thereon) by the nanofiber manufacturing system 10 will be described below.

First, a base sheet S is fed from the base sheet feeding device 20*a* to the upstream-side dielectric belt driving device 40*a*. The base sheet S fed to the upstream-side dielectric belt driving device 40*a* is put into close contact with the first dielectric belt 42 by the squeegee 52 without intervention of air bubbles and without causing occurrence of wrinkles.

The base sheet S in contact with the first dielectric belt 42 is conveyed to within the nanofiber forming space 68 of the upstream-side first nanofiber manufacturing apparatus 60. The first nanofiber manufacturing apparatus 60 discharges the raw material liquid from the nozzle 64 to form nanofiber. The formed nanofiber is deposited uniformly on the base sheet S, so that a first nanofiber layer having uniform thickness is formed on the base sheet S.

The base sheet S with the first nanofiber layer formed thereon is conveyed from the first nanofiber manufacturing apparatus 60 to within the nanofiber forming space 68 of a second (downstream-side) nanofiber manufacturing apparatus 60. In the base sheet S conveyed to the second nanofiber manufacturing apparatus 60, a second nanofiber layer is formed on the first nanofiber layer.

The base sheet S, on which the first and second nanofiber layers have been formed, is conveyed to the downstream-side dielectric belt driving device 40*b*, where contact with the first dielectric belt 42 is released.

Finally, the base sheet S, on which the first and second nanofiber layers have been formed, is wound up onto the recovery reel 26 by the base sheet recovering device 20*b*.

According to this first embodiment, a voltages is applied to the second surface 42*b* of the first dielectric belt 42 with which the base sheet S is in contact, via the second dielectric belt 66 which running in the conveyance direction A in synchronism with the first dielectric belt 42 and which is in contact with the second surface 42*b* of the first dielectric belt 42. As a result of this, there occurs dielectric polarization to the first dielectric belt 42, so that unipolar (either one of positive or negative polarity) charge is generated uniformly and dispersedly on the first surface 42*a* of the first dielectric belt 42 in contact with the base sheet S. Thus, nanofiber is deposited uniformly and dispersedly on the base sheet S on the first dielectric belt 42 without being partly concentrated. As a consequence, reliquefaction of nanofiber on the base sheet S, which could occur due to partly concentrated deposition of nanofiber on the base sheet S, is suppressed.

Also, by virtue of the arrangement that the first dielectric belt 42 and the second dielectric belt 66 are put into contact with each other so as to make nanofiber deposited uniformly and dispersedly on the main surface Sa of the base sheet S, the nanofiber manufacturing system 10 is excellent in terms of costs and maintenance.

More specifically with regard to the above point, in order to generate unipolar charge uniformly on the surface of the dielectric belt to be put into contact with the back surface Sb of the base sheet S, it is necessary for the dielectric belt to have a specified thickness. This is because too thin a dielectric belt would have effects of an electric field generated from the electrode for applying a voltage to the dielectric belt so that nanofiber is deposited concentratedly on a portion of the base sheet S corresponding to the electrode.

Accordingly, it may be conceivable that a first dielectric belt 42 having the specified thickness is used while the second dielectric belt 66 is omitted. In this case, since the first dielectric belt 42 is an elongate one, the first dielectric belt 42 involves an increase in manufacturing cost as well as a weight that makes its maintenance such as replacement difficult to do. Besides, as apparent from reference to FIG. 1, the place where the dielectric belt having the specified thickness is needed is only within the nanofiber forming space 68 of the nanofiber manufacturing apparatus 60, where nanofiber is to be deposited.

Therefore, this first embodiment adopts an arrangement, with costs and maintenance taken into consideration, that fulfills such a specified thickness that nanofiber can be deposited uniformly and dispersedly on the main surface Sa of the base sheet S by letting the first dielectric belt 42 and the second dielectric belt 66 put into contact (overlapped) with each other in the nanofiber forming space 68.

Further, by the squeegee 52, the base sheet S, on which nanofiber has not yet been deposited, is put into close contact with the surface of the first dielectric belt 42 without intervention of air bubbles and without causing occurrence of wrinkles. As a result of this, nanofiber is deposited even more uniformly on the base sheet S on the first dielectric belt 42 without being partly concentrated. Besides, the base sheet S is kept in a flat state, making it possible to form a flat nanofiber layer on the base sheet S.

Furthermore, since means for conveying the base sheet S are positioned outside the nanofiber forming space 68 as the sheet feeding device 20*a* and the sheet recovering device 20*b*, these devices 20*a*, 20*b* are never contaminated by adhesion of nanofiber. Thus, maintenance of the sheet feeding device 20*a* and the sheet recovering device 20*b* becomes easier to do.

In addition, since means for running the first dielectric belt 42 are positioned outside the nanofiber forming space 68 as the driving roll 44 of the upstream-side dielectric belt driving device 40*a* and the driving roll 46 of the downstream-side dielectric belt driving device 40*b*, these driving rolls 44, 46 are never contaminated by adhesion of nanofiber. Thus, maintenance of the driving rolls 44, 46 becomes easier to do.

Moreover, since the squeegee 52 for putting the base sheet S into close contact with the first dielectric belt 42 is also positioned outside the nanofiber forming space 68, the squeegee 52 is never contaminated by adhesion of nanofiber. Thus, maintenance of the squeegee 52 becomes easier to do.

Second Embodiment

Figure 3:
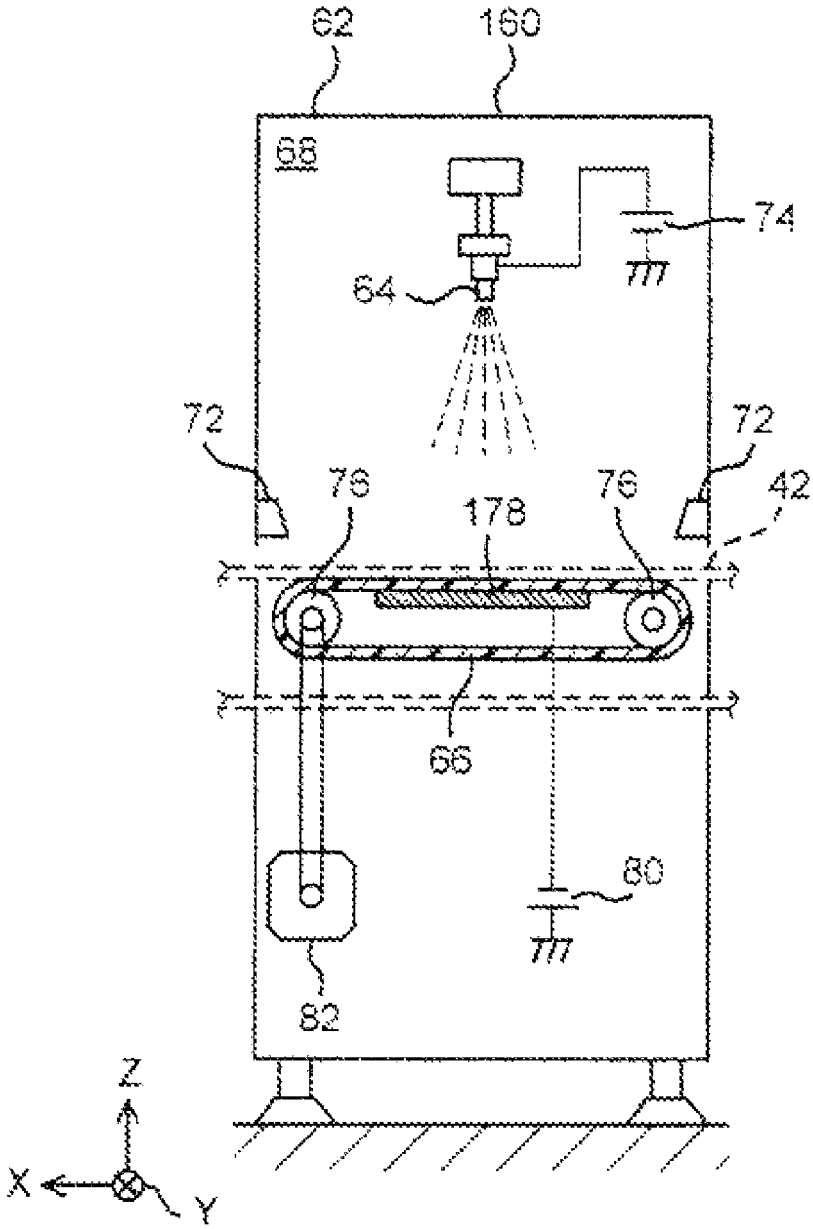
FIG. 3 is a view schematically showing a nanofiber manufacturing apparatus to be used in a nanofiber manufacturing system according to a second embodiment of the invention.

FIG. 3 schematically shows a structure of a nanofiber manufacturing apparatus to be used in a nanofiber manufacturing system according to a second embodiment of the invention. The nanofiber manufacturing system of this second embodiment is similar to the nanofiber manufacturing system of the first embodiment except for some portions. Therefore, the nanofiber manufacturing system of the second embodiment will be described principally about different portions from the first embodiment. It is noted that the same component members as in the first embodiment are designated by the same numerals as reference signs.

In the nanofiber manufacturing system 10 of the first embodiment, the plurality of electrode rolls 78 for applying voltages to the second dielectric belt 66 are provided in the form of rotatable rolls as shown in FIG. 1. However, electrode rolls are provided in a plate-shaped form in this second embodiment.

As in the first embodiment, when voltages are applied to the second dielectric belt 66 by a plurality of electrode rolls 78 (and 76) that are rotatable and that are placed in parallel with the conveyance direction A of the base sheet S, sliding resistance between the second dielectric belt 66 and the electrode rolls 76, 78 can be made to be a small one. As a result, it becomes practicable to fulfill a higher running speed of the second dielectric belt 66, so that a higher conveyance speed of the base sheet S can also be fulfilled. Also, since voltages are applied dispersedly to the second dielectric belt 66, nanofiber can be deposited over a relatively wider range of the base sheet S in the nanofiber forming space 68 of the nanofiber manufacturing apparatus 60.

In contrast to this, when a relatively lower conveyance speed, e.g. 50 m/s or lower, of the base sheet S is required, or when deposition of nanofiber over a relatively narrower range of the base sheet S in the nanofiber forming space 68 of the nanofiber manufacturing apparatus 60 is required, that is, when formation of a thick nanofiber layer is required, a plate-shaped electrode 178 provided in a plate shape according to the second embodiment can be used instead of the plurality of electrode rolls 78 that are rotatable and formed in a roll shape on condition that no adverse effects are exercised on the feeding of the base sheet S in the conveyance direction A and on the deposition of nanofiber on the base sheet S.

Because of the relatively lower conveyance speed of the sheet S, i.e., because not a higher running speed of the second dielectric belt 66 is required, wear or damage is less likely to occur to at least one of the second dielectric belt 66 having dielectric property and the plate-shaped electrode 178 provided in a plate shape, particularly to the second dielectric belt 66. Also, the plate-shaped electrode 178 increases in sliding resistance with increasing contact area with the second dielectric belt 66, so being limited in its size to some extent, but the nanofiber manufacturing apparatus can be made simpler in structure by the single-unit plate-shaped electrode 178, as compared with the plurality of electrode rolls 78.

In addition, when the plate-shaped electrode 178 is used in connection with the ground, the electrostatic collection force (sucking-up) between the plate-shaped electrode 178 and the second dielectric belt 66 becomes smaller, as compared with cases where voltages are applied, thus making it possible to increase the running speed of the second dielectric belt 66.

Also, the electrode for applying a voltage to the second dielectric belt 66 may also be provided as plate-shaped electrodes in a plural plate shape, instead of the plate-shaped electrode 178 in the form of a single-unit plate shape. In this case, the plurality of plate-shaped electrodes may be arrayed adjacently in a direction orthogonal to the conveyance direction A.

Third Embodiment

Figure 4:
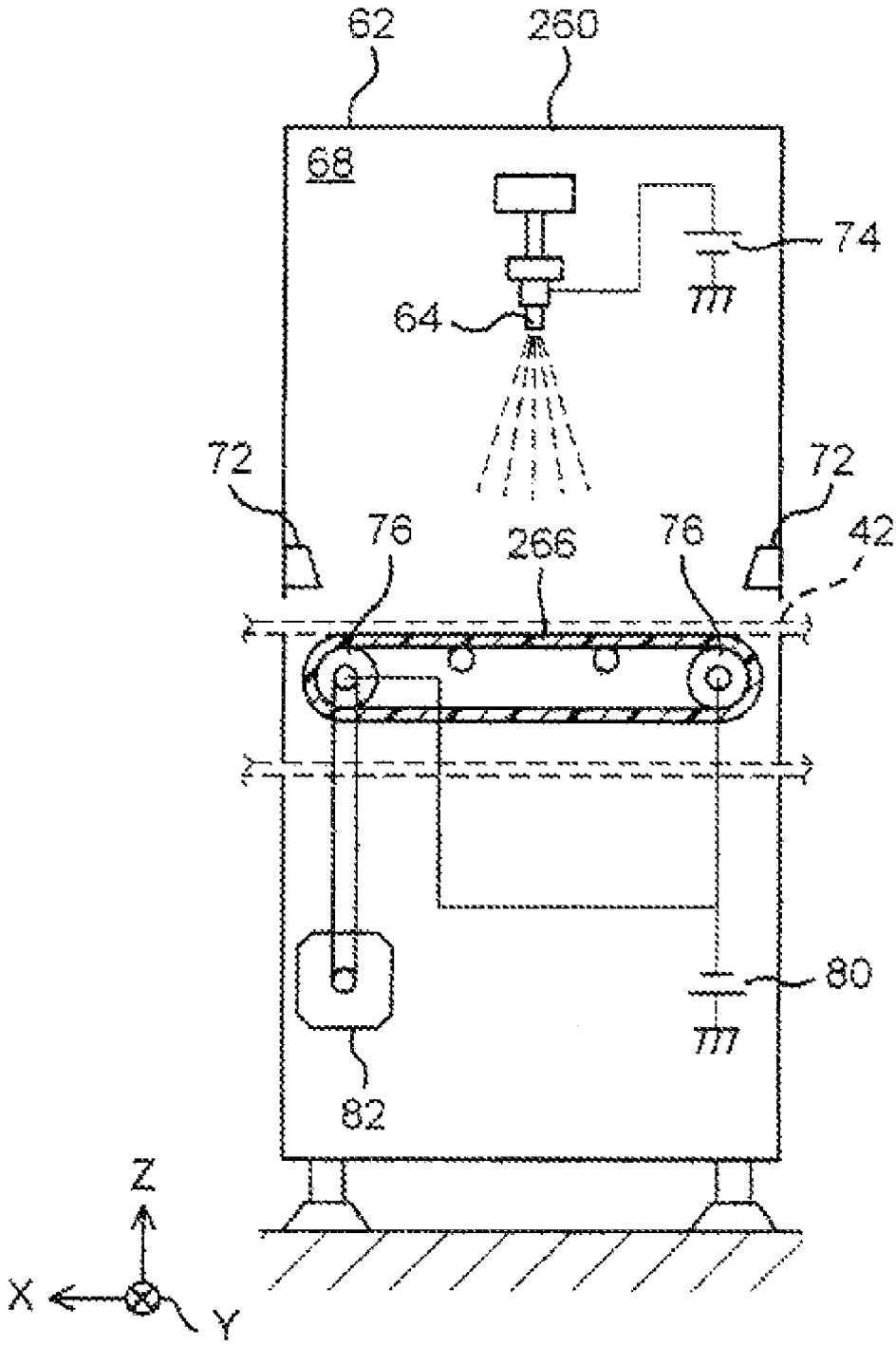
FIG. 4 is a view schematically showing a nanofiber manufacturing apparatus to be used in a nanofiber manufacturing system according to a third embodiment of the invention.

FIG. 4 schematically shows a structure of a nanofiber manufacturing apparatus to be used in a nanofiber manufacturing system according to a third embodiment of the invention. The nanofiber manufacturing system of this third embodiment is similar to the nanofiber manufacturing system of the first embodiment except for some portions. Therefore, the nanofiber manufacturing system of the third embodiment will be described principally about different portions from the first embodiment. It is noted that the same component members as in the first embodiment are designated by the same numerals as reference signs.

In the nanofiber manufacturing system 10 of the first embodiment, means for implementing dielectric polarization of the first dielectric belt 42 is provided by the second dielectric belt 66 having dielectric property. However, the means is provided by a conductive belt 266 having electrical conductivity in this third embodiment.

The conductive belt 266 is a belt made from metal, more preferably, from electrically conductive resin. Under the conditions of equal voltage applied to the belt and equal configuration of the belt, the conductive belt 266 can exercise dielectric polarization of the first dielectric belt 42 more strongly and stably, as compared with the second dielectric belt 66 of the first embodiment. As a result of this, electrostatic collecting force of the first dielectric belt 42 is increased, making it possible to deposit nanofiber on the base sheet S with higher density.

Figure 5:
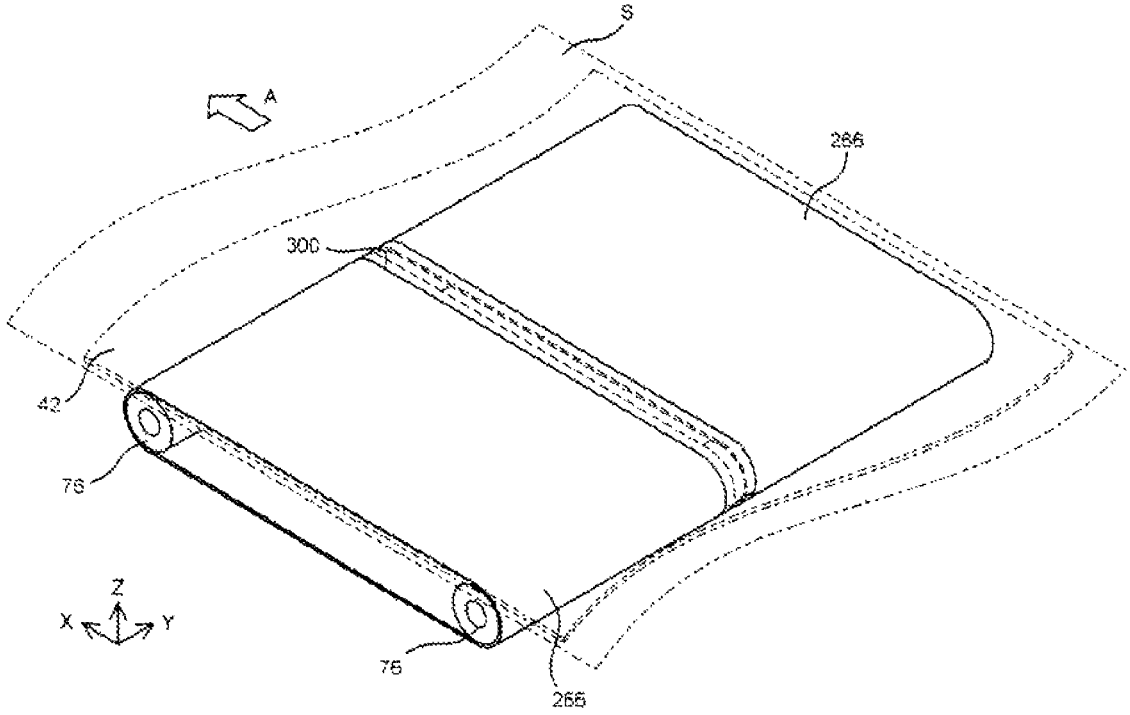
FIG. 5 is a view showing a plurality of conductive belts arrayed in a widthwise direction of a base sheet.

However, with use of the metallic conductive belt 266 and with use of a base sheet S which is larger in width (larger in Y-axis direction size) as shown in FIG. 5, it is preferable that a plurality of metallic conductive belts 266 are arrayed in the widthwise direction of base sheet S. This is because when one metallic conductive belt 266 is made in accordance with a wider base sheet S, the conductive belt becomes higher in manufacturing cost and moreover hard to handle (for replacement and conveyance) due to its size and weight, as compared with the second dielectric belt 66 of resin or conductive belts of conductive resin.

In addition, when a plurality of metallic conductive belts 266 are used so as to be arrayed in the widthwise direction (Y-axis direction) of the base sheet S as shown in FIG. 5, Y-axis direction ends of a conductive belt 266 positioned at a widthwise center of the base sheet S are preferably covered with a dielectric belt 300. This is because nanofiber is deposited concentratedly at portions of the base sheet S corresponding to the Y-axis direction ends of the conductive belt 266.

Although the invention has been described by taking three embodiments hereinabove, the invention is not limited to these embodiments.

For example, whereas the nanofiber manufacturing apparatuses are provided two in number in the above-described three embodiments, this is not limitative. The nanofiber manufacturing system, only if having at least one nanofiber manufacturing apparatus, is enabled to fabricate nanofiber sheets.

Also, for example, the base sheet S is provided as an elongate one in the above-described embodiments. However, the invention is applicable also to rectangular-shaped base sheets S. In this case, taking the case of the first embodiment as an example, the base sheet feeding device 20*a* and the base sheet recovering device 20*b* are eliminated from the nanofiber manufacturing system 10. Instead, a device for placing a rectangular-shaped base sheet S on an upstream-side end of the first dielectric belt 42, and a device for recovering the base sheet S, on which a nanofiber layer has been formed, at a downstream-side end of the first dielectric belt 42 are set up. That is, the first dielectric belt 42 serves as a conveyance means for the base sheet S.

Besides, for example, the second dielectric belt 66 is provided one for each one nanofiber manufacturing apparatus 60 in the case of the first embodiment as shown in FIG. 1. However, the second dielectric belt 66 may be provided in such a form as to pass through the nanofiber forming spaces 68 of a plurality of nanofiber manufacturing apparatuses 160.

Furthermore, the first dielectric belt 42 may be made by forming a resin layer on a surface (top surface on the base sheet S side) of a metallic belt.

In addition, although the squeegee 52 acts to put the base sheet S into close contact with the first dielectric belt 42 in the above embodiments, the invention is not limited to this. It is also allowable, for example, that a pair of rolls are rotated with the base sheet S and the first dielectric belt 42 sandwiched therebetween so as to put those members into close contact with one another while bleeding air away.

Furthermore, in the above-described embodiments, voltages are applied to the second surface 42*b* of the first dielectric belt 42 via the second dielectric belt 66 or the conductive belt 266. However, voltages may also be applied directly.

Although the present invention has been fully described in connection with the preferred embodiments thereof with reference to the accompanying drawings, it is to be noted that various changes and modifications are apparent to those skilled in the art. Such Changes and modifications are to be understood as included within the scope of the present invention as defined by the appended claims unless they depart therefrom.

The entire disclosure of Japanese Patent Application No. 2010-219153 filed on Sep. 29, 2010, including specification, claims, drawings, and summary are incorporated herein by reference in its entirety.

INDUSTRIAL APPLICABILITY

Without limitations to such specific nanofiber manufacturing systems as shown in FIG. 1, this invention is applicable to those systems and apparatuses for forming nanofiber from a raw material liquid by electrostatic explosions and depositing the resulting nanofiber onto a base sheet.

The invention claimed is:

1. A nanofiber manufacturing system in which nanofiber is formed from a raw material liquid by electrostatic explosions in a nanofiber forming space and the formed nanofiber is collected and deposited on a main surface of a base sheet, comprising:

a first dielectric belt having dielectric property and including first and second surfaces;

a sheet conveying device for conveying the base sheet in the nanofiber forming space;

a sheet contacting device for putting a back surface of the base sheet and the first surface of the first dielectric belt into contact with each other;

a dielectric belt driving device for running the first dielectric belt in a base-sheet conveyance direction within the nanofiber forming space while the first surface of the first dielectric belt is kept in contact with the back surface of the base sheet; and a voltage applying device for applying a voltage to the second surface of the first dielectric belt so that dielectric polarization occurs to the first dielectric belt.

2. The nanofiber manufacturing system according to claim 1, further comprising a second dielectric belt having dielectric property which is moved in a running direction of the first dielectric belt while being kept in contact with the second surface of the first dielectric belt, wherein the voltage applying device applies a voltage to the second surface of the first dielectric belt via the second dielectric belt.

3. The nanofiber manufacturing system according to claim 1, further comprising a conductive belt having electrical conductivity which is moved in a running direction of the first dielectric belt while being kept in contact with the second surface of the first dielectric belt, wherein the voltage applying device applies a voltage to the second surface of the first dielectric belt via the conductive belt.

4. The nanofiber manufacturing system according to claim 1, wherein the voltage applying device includes at least one or more electrodes for applying a voltage to the second surface of the first dielectric belt, and wherein the at least one or more electrodes are formed in a plate shape and placed so as to be arrayed in a direction orthogonal to the sheet conveyance direction.

5. The nanofiber manufacturing system according to claim 1, wherein the voltage applying device includes at least one or more electrodes for applying a voltage to the second surface of the first dielectric belt, and wherein the at least one or more electrodes are formed in a rotatable roll shape.

6. The nanofiber manufacturing system according to claim 1, wherein the dielectric belt driving device includes a driving roll which, while supporting the first dielectric belt, is rotated so as to run the first dielectric belt, and wherein the driving roll is placed outside the nanofiber forming space.

7. The nanofiber manufacturing system according to claim 1, wherein the base sheet is an elongate base sheet which passes through the nanofiber forming space, and the sheet conveying device comprises:

a sheet feeding device which is placed outside the nanofiber forming space and which feeds out the base sheet toward within the nanofiber forming space; and a sheet recovering device which is placed outside the nanofiber forming space and which recovers the base sheet on which nanofiber has been deposited and which has passed through the nanofiber forming space.

8. The nanofiber manufacturing system according to claim 1, further comprising a drying device for drying nanofiber deposited on the base sheet.

9. The nanofiber manufacturing system according to claim 1, further comprising a static elimination device for eliminating static charge from the base sheet with nanofiber deposited thereon.

10. A nanofiber manufacturing method in which nanofiber is formed from a raw material liquid by electrostatic explosions in a nanofiber forming space and the formed nanofiber is collected and deposited on a main surface of a base sheet, comprising:

conveying the base sheet in the nanofiber forming space;

putting a back surface of the base sheet and a first surface of a first dielectric belt of dielectric property into contact with each other;

running the first dielectric belt having dielectric property in a conveyance direction of the base sheet while the first dielectric belt is kept in contact with the base sheet; and applying a voltage to a second surface of the first dielectric belt so that dielectric polarization occurs to the first dielectric belt, whereby nanofiber is electrostatically collected onto the main surface of the base sheet.

11. The nanofiber manufacturing method according to claim 10, further comprising:

running a second dielectric belt having dielectric property in a running direction of the first dielectric belt while the second dielectric belt is kept in contact with the second surface of the first dielectric belt; and applying a voltage to the second surface of the first dielectric belt via the second dielectric belt.

12. The nanofiber manufacturing method according to claim 10, further comprising:

running an electrically conductive belt in a running direction of the first dielectric belt while the conductive belt is kept in contact with the second surface of the first dielectric belt; and applying a voltage to the second surface of the first dielectric belt via the conductive belt.

* * * * *